US005534129A

United States Patent [19]

Hoffacker et al.

[11] Patent Number: 5,534,129

[45] Date of Patent: Jul. 9, 1996

[54] CYANIDIC-ALKALINE BATHS FOR THE GALVANIC DEPOSITION OF COPPER-TIN ALLOY COATINGS, USES THEREOF, AND METALLIC BASES COATED WITH SAID COPPER-TIN ALLOY COATING

[75] Inventors: Gerd Hoffacker, Alfdorf; Hasso Kaiser, Schwaebisch Gmuend; Klaus Reissmueller, Spraitbach; Guenter Wirth, Heubach, all of Germany

[73] Assignee: Degussa Aktiengesellschaft, Frankfurt, Germany

[21] Appl. No.: 277,631

[22] Filed: Jul. 20, 1994

[30] Foreign Application Priority Data

Jul. 26, 1993 [DE] Germany ..... 43 24 995.7

[51] Int. Cl.[6] ..... C25D 3/58; C25D 3/60

[52] U.S. Cl. ..... 205/241; 205/253; 205/254

[58] Field of Search ..... 205/50, 241, 253, 205/295, 296, 298, 301, 302, 303, 304, 254; 106/1.12, 1.13, 1.18, 1.25, 1.26

[56] References Cited

U.S. PATENT DOCUMENTS

| | | | |
|---|---|---|---|
| 2,849,352 | 8/1958 | Kirstahler et al. | 205/241 |
| 2,916,423 | 12/1959 | Passal | 204/44 |
| 4,565,608 | 1/1986 | Hoffacker et al. | 204/44 |
| 5,149,566 | 8/1992 | Morton et al. | 427/235 |

OTHER PUBLICATIONS

Chemical Abstracts, vol. 100, No. 12, 19 Mar. 1984, abstract No. 93503n.

Patent Abstracts of Japan C–122, 2 Sep. 1982, vol. 6, No. 169, abstract 57–82492A.

*Primary Examiner*—John Niebling
*Assistant Examiner*—Edna Wong
*Attorney, Agent, or Firm*—Beveridge, DeGrandi, Weilacher & Young

[57] ABSTRACT

In order to produce bright to brilliant, leveled copper-tin alloy coatings, galvanic baths are used which contain 1 to 60 g/l copper in the form of copper(I) cyanide, 1 to 50 g/l tin in the form of alkali stannate, 0 to 10 g/l zinc in the form of zinc cyanide, 1 to 200 g/l of one or several complex binders (e.g., oligosaccharides and/or polysaccharides), 1 to 100 g/l free alkali metal cyanide, 1 to 50 g/l free alkali metal hydroxide, 0 to 50 g/l alkali metal carbonate 0.01 to 5 g/l brightener (e.g., alkene sulfonate, alkyne sulfonate, pyridine compounds or sulfur-containing propane sulfonates) and 0 to 100 mg/l lead as lead(II) acetate or lead(II) sulfonate.

17 Claims, No Drawings

CYANIDIC-ALKALINE BATHS FOR THE GALVANIC DEPOSITION OF COPPER-TIN ALLOY COATINGS, USES THEREOF, AND METALLIC BASES COATED WITH SAID COPPER-TIN ALLOY COATING

INTRODUCTION AND BACKGROUND

The present invention concerns alkaline-cyanidic baths for the galvanic deposition of bright to brilliant, leveled copper-tin alloy coatings. The baths contain 1 to 60 g/l copper in the form of copper(I) cyanide, 1 to 50 g/l tin in the form of alkali metal stannate, 0 to 10 g/l zinc in the form of zinc cyanide, 1 to 200 g/l of one or more complex binders, 1 to 100 g/l free alkali metal cyanide, 1 to 50 g/l free alkali metal hydroxide, 0 to 50 g/l alkali metal carbonate, 0.01 to 5 g/l brightener and 0 to 100 mg/l lead as lead(II) acetate or lead(II) sulfonate. The present invention also concerns a method of electrolytically depositing a bright to brilliant, leveled copper-tin alloy coating on a metal substrate which involves employing the alkaline-cyanidic bath described herein at a temperature of 40° to 62° C. Furthermore, the present invention concerns a metallic base coated with a copper-tin alloy coating prepared by the method described herein.

Baths are required in decorative surface technology which coat the surface of the base support in a uniform manner which is true to the contour of the base support and which compensate for any unevenness of the substrate (leveling). In addition, they must selectively produce a matte finish, satiny-matte or brilliant luster. These requirements are met in particular by galvanic nickel baths known in the art both for the deposition of nickel layers as final support and also as foundation prior to a subsequent coating with noble metals. However, there is the disadvantage that nickel is allergenic for a considerable part of the population.

The deposition of copper-tin coatings from galvanic baths has been known for many years. In particular, coatings are used which contain 45 to 60% copper since they have a bright silver luster and do not tend to tarnish, or coatings are used which comprise 75 to 85 % copper since they have a yellow to golden yellow color. The former are therefore used in decorative galvanotechnology as a replacement for e.g. silver, nickel, chromium or aluminum. However, copper-tin coatings are also increasingly being used industrially in other areas on account of their very good soldering properties, their wear resistance, corrosion resistance and their low electric transition resistance. The latter are used primarily in decorative galvanotechnology as a replacement for brass and as the undercoating prior to a galvanic gilding. Layers of copper-tin alloys do not cause any known allergies on the human skin.

Copper-tin alloys are deposited primarily from alkaline, cyanide-containing electrolytes containing copper as copper(I)-cyanide and tin as sodium stannate. Other electrolytes contain phosphate and/or polyphosphate as complex binder and, moreover, colloids such as e.g. polypeptides as brighteners (DE 860,300). These known baths must be operated at high constant temperatures (65° C. and higher) in order to obtain uniform layers with a constant composition. Working with these baths is therefore difficult and complicated.

The copper-tin baths can also contain zinc salts, as a result of which a few percent zinc is also deposited.

Recently, copper-tin alloying baths have become known (U.S. Pat. Nos. 4,565,608 and 4,605,474 which are incorporated by reference in their entirety; DE 3,339,541) which, in addition to copper cyanide, alkali stannate, phosphates, free alkali cyanide and free alkali hydroxide, also contain organic substances in the form of fatty acid-imido-alkyl-dialkyl-amino oxides, fatty acid-amido-alkyl-dialkyl amine betaines and/or ethoxylated naphthols as complex binders and contain polyethylene diamines, benzaldehydes, ethinols and/or benzylpyridine carboxylates as brightening agents. These baths also require a monitoring of the content of free cyanide and hydroxide. Moreover, they exhibit only a weak leveling action. The same applies to copper-tin alloying baths containing 3 to 12 g/l monosaccharides as complex binder (Pat. Abstr. of Japan, C-122 Sep. 2, 1982, vol. 6/No. 169, Jp 57-82492).

SUMMARY OF THE INVENTION

One object of the present invention therefore was to develop cyanidic-alkaline baths for the galvanic deposition of copper-tin alloy coatings which exhibit good leveling action.

It is a further object of the present invention to compensate for fluctuations of the bath components.

A further object is to provide layers of copper-tin alloy coatings that are brilliant.

Accordingly, the above and other objects of the present invention are achieved by using an alkaline cyanidic bath comprising 1 to 60 g/l copper in the form of copper(I) cyanide, 1 to 50 g/l tin in the form of alkali metal stannate, 0 to 10 g/l zinc in the form of zinc cyanide, 1 to 200 g/l of one or more complex binders, 1 to 100 g/l free alkali metal cyanide, 1 to 50 g/l free alkali metal hydroxide and 0 to 50 g/l alkali metal carbonate, and 0 to 100 mg/l lead as lead(II) acetate or lead(II) sulfonate.

It is a feature of the present invention that the baths contain as complex binder oligosaccharides and/or polysaccharides in amounts of 1 to 200 g/l and additionally 0.01 to 5 g/l of one or several brighteners selected from one or several of the following groups:

(a) Alkene sulfonates of the general formula $$R—CH{=}CH—(CH_2)_n—So_3Na$$

and its derivatives, in which R=H, $CH_3$, $C_2H_5$, $C_3H_7$, $C_2H_3$ or $C_6H_5$ and n=0 to 5.

(b) Alkyne sulfonates of the general formula $$R—(CH_2)_m—C{\equiv}C—(CH_2)_n—SO_3Na$$

and its derivatives, in which R=H, $CH_3$, $C_2H_5$, $C_3H_7$ or $C_6H_5$, m=0 to 5 and n=0 to 5.

(c) Pyridinium compounds of the general formula

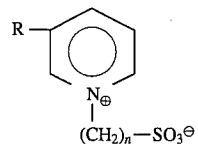

and its derivatives, in which R=H, CHO, $CH_3$, $C_2H_3O$, $CONH_2$, $C_2H_3$ or $C_6H_5$—$CH_2$ and n=1 to 5 and R can occur in ortho, meta or para position.

(d) Sulfur-containing propane sulfonates of the general formula $$R—(CH_2)_3—SO_3^-$$

and its derivatives, in which R=—OH —NH—C—$(CH_2OH)_3$

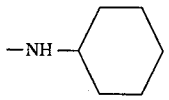

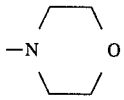

$-S-S-(CH_2)_3-SO_3^-$ $-S-S-CH_2-O-C_2H_5$ $-S-S-CH_2-N-(CH_3)_2$ $-S-\underset{\underset{\oplus NH_2}{\|}}{C}-NH_2$ and

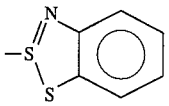

Oligosaccharides based on pentose and hexose have proven themselves especially well (e.g., lactose).

The baths preferably contain 50 to 150 g/l of complexing agents.

Another object of the present invention concerns a method of electrolytically depositing a bright to brilliant, leveled copper-tin alloy coating on a metal substrate which involves employing the alkaline-cyanidic bath described herein at a temperature of 40° to 62° C. Furthermore, the present invention concerns a metallic base coated with a copper-tin alloy coating prepared by the method described herein.

DETAILED DESCRIPTION OF THE INVENTION

Oligosaccharides include, but are not limited to, saccharose, trehalose, cellobiose, raffinose, and preferably lactose or maltose. Polysaccharides include, but are not limited to, cellulose and preferably starches or dextrin.

The coating may be deposited, for example, on brass, iron with copper layer (ca. 3 μm Cu layer), tin and zinc also with copper layer (ca. 5 μm Cu layer), steel, ferrous or nickel parts or sheets.

Baths with the above composition are not very sensitive to fluctuations in the hydroxide- and cyanide content. The coatings deposited from such baths are bright and brilliant. Moreover, the current density range which can be used to obtain uniform layers is surprisingly relatively small with 1 to 3 A/dm$^2$. The baths preferably contain 0.5 to 1.5 g/l of such brighteners. The baths are aqueous.

The following brighteners are preferred: From group (a) e.g. allyl sulfonate, vinyl sulfonate; from group (b) propyne sulfonate and butyne sulfonate; from group (c) 1-(3-sulfopropyl)-2-vinyl pyridinium betaine, 4-methyl-1-(3-sulfopropyl) pyridinium betaine, 4-benzyl-1-(3-sulfopropyl) pyridinium betaine; and from group (d) S-isothiuronium-3-propane sulfonate, o-ethyldithiocarbonic acid-(3-sulfopropyl) ester potassium salt.

The baths of the present invention are less dependent on fluctuations of the bath components. The coatings release no known allergic components and can therefore also replace nickel coatings.

The baths in accordance with the present invention can be operated with insoluble anodes such as e.g. with graphite anodes.

The operating temperatures are at 40° to 62° C., the current densities between 0.1 and 5 A/dm$^2$ and the pH's between 11 and 13.

The present baths preferably contain 5 to 25 g/l copper in the form of copper(I) cyanide, 5 to 40 g/l tin in the form of sodium stannate, 50–150 g/l complex binder, 20 to 60 g/l free alkali metal cyanide (e.g., potassium cyanide), 2 to 40 g/l free alkali metal hydroxide (e.g., potassium hydroxide), 0.5 to 1.5 g/l brightener and possibly 1 to 100 mg/l lead as lead(II) acetate.

In addition to the complex binders of the present invention, the copper-tin baths can also contain in addition known complex binders such as phosphates (e.g., sodium phosphate or potassium phosphate), polyphosphates (e.g., sodium polyphosphate or potassium polyphosphate), phosphonates (e.g., disodium methylenediphosphonate, disodium hydroxymethanediphosphonate, or disodium hydroxyethanediphosphonate), polyhydroxy carboxylic acids and salts thereof (e.g., tartaric acid, citric acid, gluconic acid, and their sodium and potassium salts), hydroxy carboxylic acids, amino carboxylic acids or polyoxy carboxylic acids, or potassium sodium tartrate.

The following examples are intended to explain the baths of the invention in detail:

EXAMPLES 1. 4 μm thick, white, brilliant coatings containing 55% copper and which do not tarnish are obtained from a bath with 12 g/l copper(I) cyanide, 50 g/l sodium stannate, 20 g/l potassium sodium tartrate (which also acts as a complex binder), 20 g/l lactose, 50 g/l free potassium cyanide, 5 g/l potassium hydroxide, 0.5 g/l sodium salt of propyl sulfonic acid and 18 mg/l lead(II) acetate at a temperature of 58° C. and a current density of 1.5 A/dm$^2$ with>70% current yield in 10 minutes.

2. 4 μm thick, white, brilliant coatings containing 55% copper and which do not tarnish are obtained from a bath with 12 g/l copper(I) cyanide, 100 g/l sodium stannate (which corresponds to about 35 g/l tin), 20 g/l potassium sodium tartrate, 20 g/l lactose, 50 g/l free potassium cyanide, 30 g/l free potassium hydroxide, 0.5 g/l sodium salt of propyl sulfonic acid and 18 mg/l lead(II) acetate at a temperature of 58° C. and a current density of 0.5 A/dm$^2$ with>70% current yield in 30 minutes.

3. 3 μm thick, white, high-gloss coatings containing 55% copper, 42% tin, 2.9% zinc and 0.1% lead and which do not tarnish are obtained from a bath with 17.5 g/l copper(I) cyanide, 36 g/l sodium stannate, 2 g/l zinc oxide (which is converted to zinc cyanide in the bath), 20 g/l potassium sodium tartrate, 20 g/l lactose, 20 g/l dextrin, 50 g/l free potassium cyanide, 10 g/l free potassium hydroxide, 0.5 g/l sodium salt of propyl sulfonic acid, 0.2 g/l 4-benzyl-1-(3-sulfopropyl) (i.e., a dash) pyridinium betaine and 18 mg/l lead(II) acetate at a temperature of 55° C. and a current density of 1 A/dm$^2$ with>70% current yield in 10 minutes.

4. 4 μm thick, yellow, high-gloss and leveled coatings containing 80% copper are obtained from a bath with 14.1 g/l copper(I) cyanide, 50 g/l sodium stannate, 20 g/l potassium sodium tartrate, 20 g/l lactose, 0.5 g/l soluble starch, 35 g/l free potassium cyanide, 25 g/l free potassium hydroxide and 1 g/l sodium salt of allyl sulfonic acid at a temperature of 50° C. and a current density of 3 A/dm$^2$ with>70% current yield in 10 minutes.

5. 12 μm thick, yellow, high-gloss and leveled coatings containing 80% copper, 17% tin, 2.5% zinc and 0.5% lead are obtained from a bath with 17.5 g/l copper(I) cyanide, 36 g/l sodium stannate, 2 g/l zinc cyanide, 20 g/l potassium sodium tartrate, 20 g/l maltose, 1 g/l soluble starch, 35 g/l free potassium cyanide, 5 g/l free potassium hydroxide, 1 g/l sodium salt of allyl sulfonic acid, 0.5 g/l 4-benzyl-1-(3-sulfopropyl) pyridinium betaine and 30 mg/l lead(II) acetate at a temperature of 55° C. and a current density of 3 A/dm$^2$ with>70% current yield in 20 minutes.

6. 5 μm thick, yellow, high-gloss and leveled coatings containing 80% copper, 17% tin, 2.5% zinc and 0.5% lead are obtained from a bath with 30 g/l copper(I) cyanide, 36 g/l sodium stannate, 2 g/l zinc cyanide, 20 g/l potassium sodium tartrate, 20 g/l maltose, 1 g/l soluble starch, 35 g/l free potassium cyanide, 5 g/l free potassium hydroxide, 1 g/l sodium salt of allyl sulfonic acid, 0.5 g/l 4-benzyl-1-(3-sulfopropyl) pyridinium betaine and 30 mg/l lead(II) acetate at a temperature of 55° C. and a current density of 0.5 A/dm$^2$ with>70% current yield in 50 minutes.

Further variations and modifications of the foregoing will be apparent to those skilled in the art and such variations and modifications are attended to be encompassed by the claims that are appended hereto.

German Priority Application P 43 24 995.7, filed on Jul. 26, 1993, are relied on and incorporated by reference.

What is claimed:

1. An alkaline-cyanidic bath for the electrolytic deposition of bright to brilliant, leveled copper-tin alloy coatings, said bath comprising 1 to 60 g/l copper in the form of copper(I) cyanide, 1 to 50 g/l tin in the form of alkali metal stannate, 0 to 10 g/l zinc in the form of zinc cyanide, 1 to 100 g/l free alkali metal cyanide, 1 to 50 g/l free alkali metal hydroxide, 0 to 50 g/l alkali metal carbonate, 0 to 100 mg/l lead as lead(II) acetate or lead(II) sulfonate, 1 to 200 g/l of at least one complex binder selected from the group consisting of oligosaccharides, polysaccharides and mixtures thereof, and 0.01 to 5 g/l of at least one brightener selected from the group consisting of:

(a) alkene sulfonates of the formula $$R—CH=CH—(CH_2)_n—SO_3Na$$

and its derivatives, in which R=H, $CH_3$, $C_2H_5$, $C_3H_7$, $C_2H_3$ or $C_6H_5$ and n=0 to 5;

(b) alkyne sulfonates of the formula $$R—(CH_2)_m—C=C—(CH_2)_n—SO_3Na$$

and its derivatives, in which R=H, $CH_3$, $C_2H_5$, $C_3H_7$ or $C_6H_5$, m=0 to 5 and n=0to 5;

(c) pyridinium compounds of the formula

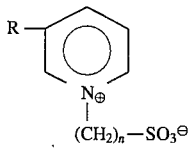

and its derivatives, in which R=H, CHO, $CH_3$, $C_2H_3O$, $CH_3$, $CONH_2$, $C_2H_3$ or $C_6H_5$—$CH_2$ and n=1 to 5, and R can occur in ortho, meta or para position; and (d) sulfur-containing propane sulfonates of the formula $$R—(CH_2)_3—SO_3^-$$

and its derivatives, in which R=—OH —NH—C—$(CH_2OH)_3$

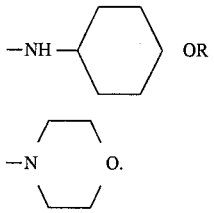

2. The alkaline-cyanidic bath according to claim 1, wherein said oligosaccharide is selected from the group consisting of saccharose, trehalose, cellobiose, raffinose, lactose, maltose and mixtures thereof.

3. The alkaline-cyanidic bath according to claim 1, containing 50 to 150 g/l of said complex binder.

4. The alkaline-cyanidic baths according to claim 1, containing 0.5 to 1.5 g/l of said brightener.

5. The alkaline-cyanidic bath according to claim 1, wherein said alkene sulfonate is at least one compound selected from the group consisting of allyl sulfonate, vinyl sulfonate and mixtures thereof.

6. The alkaline-cyanidic bath according to claim 1, wherein said alkyne sulfonate is at least one compound selected from the group consisting of propyne sulfonate, butyne sulfonate and mixtures thereof.

7. The alkaline-cyanidic bath according to claim 1, wherein said pyridinium compound is at least one compound selected from the group consisting of 1-(3-sulfopropyl)-2-vinyl pyridinium betaine, 4-methyl-1-(3-sulfopropyl) pyridinium betaine, 4-benzyl-1-(3-sulfopropyl) pyridinium betaine and mixtures thereof.

8. The alkaline-cyanidic bath according to claim 1, wherein said sulfur-containing propane sulfonate is at least one compound selected from the group consisting of S-isothiuronium-3-propane sulfonate, o-ethyl-dithiocarbonic acid-(3-sulfopropyl) ester potassium salt and mixtures thereof.

9. The alkaline-cyanidic bath according to claim 1, wherein said bath has an operating temperature of 40° to 62° C.

10. The alkaline-cyanidic bath according to claim 1, wherein said bath has a current density between 0.1 and 5.0 A/dm$^2$.

11. The alkaline-cyanidic bath according to claim 1, wherein said bath has a pH between 11 and 13.

12. The alkaline-cyanidic bath according to claim 1, wherein said bath comprises 5 to 25 g/l copper in the form of copper(I) cyanide, 5 to 40 g/l tin in the form of sodium stannate, 50–150 g/l complex binder, 20 to 60 g/l free alkali metal cyanide, 2 to 40 g/l free alkali metal hydroxide, 0.5 to 1.5 g/l brightener and optionally 1 to 100 mg/l lead as lead(II) acetate.

13. The alkaline-cyanidic bath according to claim 1, wherein said polysaccharide is selected from the group consisting of cellulose, dextrin, soluble starch, and mixtures thereof.

14. The alkaline-cyanidic bath according to claim 1, said bath consisting essentially 1 to 60 g/l copper in the form of copper(I) cyanide, 1 to 50 g/l tin in the form of alkali metal stannate, 0 to 10 g/l zinc in the form of zinc cyanide, 1 to 100 g/l free alkali metal cyanide, 1 to 50 g/l free alkali metal hydroxide: 0 to 50 g/l alkali metal carbonate, 0 to 100 mg/l lead as lead(II) acetate or lead(II) sulfonate, 1 to 200 g/l of at least one complex binder which is selected from the group consisting of oligosaccharides, polysaccharides and mixtures thereof, and 0,01. to 5 g/l of at least one brightener selected from the group consisting of:

(a) alkene sulfonates of the formula $$R—CH=CH—(CH_2)_n—SO_3Na$$

and its derivatives, in which R=H, $CH_3$, $C_2H_5$, $C_3H_7$, $C_2H_3$ or $C_6H_5$ and n=0 to 5;

(b) alkyne sulfonates of the formula $$R—(CH_2)_m—C\equiv C—(CH_2)_n—SO_3Na$$

and its derivatives, in which R=H, $CH_3$, $C_2H_5$, $C_3H_7$ or $C_6H_5$, m=0 to 5 and n=0 to 5;

(c) pyridinium compounds of the formula

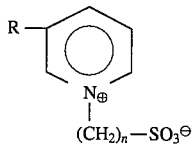

and its derivatives, in which R=H, CHO, $C_2H_3O$, $CH_3$, $CONH_2$, $C_2H_3$ or $C_6H_5$—$CH_2$ and n=1 to 5, and R can occur in ortho, meta or para position; and (d) sulfur-containing propane sulfonates of the formula $$R—(CH_2)_3—SO_3^-$$

and its derivatives, in which R=—OH

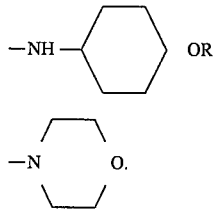

and optionally at least one additional complex binder which is not an oligosaccharide a polysaccharide or a mixture thereof.

15. A method of electrolytically depositing a bright to brilliant, leveled copper-tin alloy coating on a metal substrate, said method comprising employing at a temperature of 40° to 62° C. an alkaline-cyanidic bath comprising 1 to 60 q/l copper in the form of copper(I) cyanide, 1 to 50 g/l tin in the form of alkali metal stannate, 0 to 10 g/l zinc in the form of zinc cyanide, 1 to 100 q/l free alkali metal cyanide, 1 to 50 q/l free alkali metal hydroxide, 0 to 50 g/l alkali metal carbonate, 0 to 100 mg/l lead as lead(II) acetate or lead(II) sulfonate, 1 to 200 g/l of at least one complex binder selected from the group consisting of oligosaccharides, polysaccharides and mixtures thereof, and 0.01 to 5 g/l of at least one brightener selected from the group consisting of:

(a) alkene sulfonates of the formula $$R—CH=CH—(CH_2)_n—SO_3Na$$

and its derivatives, in which R=H, $CH_3$, $C_2H_5$, $C_3H_7$, $C_2H_3$ or $C_6H_5$ and n=0 to 5;

(b) alkyne sulfonates of the formula $$R—(CH_2)_m—C\equiv C—(CH_2)_n—SO_3Na$$

and its derivatives, in which R=H, $CH_3$, $C_2H_5$, $C_3H_7$ or $C_6H_5$, m=0 to 5 and n=0 to 5;

(c) pyridinium compounds of the formula

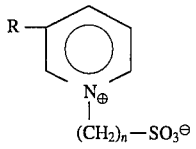

and its derivatives, in which R=H, CHO, $CH_3$, $C_2H_3O$, $CH_3$, $CONH_2$, $C_2H_3$ or $C_6H_5$—$CH_2$ and n=1 to 5, and R can occur in ortho, meta or para position;

(d) sulfur-containing propane sulfonates of the formula $$R—(CH_2)_3—SO_3^-$$

and its derivatives, in which R=—OH —NH—C—$(CH_2OH)_3$

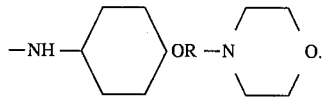

16. The method according to claim 15, wherein said bath has a current density between 0.1 and 5 A/dm$^2$.

17. The method according to claim 15, wherein said bath has a pH between 11 and 13.

* * * * *